United States Patent [19]

Schwartz et al.

[11] Patent Number: 4,604,048

[45] Date of Patent: Aug. 5, 1986

[54] METHODS AND APPARATUS FOR BURNING FUEL WITH LOW $NO_x$ FORMATION

[75] Inventors: Robert E. Schwartz; Roger K. Noble, both of Tulsa, Okla.

[73] Assignee: John Zink Company, Tulsa, Okla.

[21] Appl. No.: 731,080

[22] Filed: May 6, 1985

[51] Int. Cl.[4] ..... F23C 5/00

[52] U.S. Cl. ..... 431/8; 431/187; 431/188; 431/349; 239/559

[58] Field of Search ..... 431/8, 177, 181, 187, 431/188, 349, 284, 285, 174; 239/558, 559

[56] References Cited

U.S. PATENT DOCUMENTS

| | | | |
|---|---|---|---|
| 2,395,276 | 2/1946 | Jordan . | |
| 2,851,093 | 9/1958 | Zink, Jr. et al. . | |
| 2,857,204 | 10/1958 | Gross | 239/559 |
| 2,869,631 | 1/1959 | Zink . | |
| 2,981,320 | 4/1961 | Reed . | |
| 3,174,527 | 3/1965 | Reed et al. . | |
| 3,179,151 | 4/1965 | Reed . | |
| 3,180,395 | 4/1965 | Reed . | |
| 3,302,596 | 2/1967 | Zinn | 431/284 |
| 3,308,869 | 3/1967 | Livingston | 431/8 |
| 3,850,571 | 11/1974 | Zink et al. | 431/349 |
| 4,004,875 | 1/1977 | Zink et al. . | |
| 4,245,980 | 1/1981 | Reed et al. . | |
| 4,395,223 | 7/1983 | Okigami et al. . | |
| 4,505,666 | 3/1985 | Martin et al. . | |

FOREIGN PATENT DOCUMENTS

| | | | |
|---|---|---|---|
| 2098642 | 3/1972 | France | 431/8 |

*Primary Examiner*—Carroll B. Dority, Jr.

*Attorney, Agent, or Firm*—Laney, Dougherty, Hessin, Claro & Beavers

[57] ABSTRACT

Methods and apparatus for combusting fuel-air mixtures while inhibiting the formation of nitrogen oxides are provided. The fuel is discharged from one or more nozzles disposed within a housing, air is caused to flow into the housing whereby it mixes with the fuel and the resulting fuel-air mixture is ignited and combusted. The nozzle or nozzles each include one or more ignition orifices for discharging a first portion of fuel in an ignition zone, one or more primary combustion orifices for discharging a second portion of fuel in a primary combustion zone containing excess air and one or more secondary combustion orifices arranged for discharging the remaining portion of fuel in the form of high velocity jets shielded by slower moving fuel within the downstream of the primary combustion zone whereby the fuel is burned in a secondary combustion zone substantially isolated from direct contact with incoming air by the primary combustion zone.

12 Claims, 9 Drawing Figures

METHODS AND APPARATUS FOR BURNING FUEL WITH LOW $NO_x$ FORMATION

BACKGROUND OF THE INVENTION

1. Field of the Invention

The present invention relates generally to methods and burner apparatus for combusting fuel-air mixtures, and more particularly, to methods and burner apparatus for combusting fuel and air while inhibiting the formation of nitrogen oxides.

2. Description of the Prior Art

A variety of methods and burner apparatus for combusting fuel and air mixtures have been developed and utilized heretofore. Such burner apparatus are used in a great variety of applications where fuel is combusted to provide heat for a particular purpose, e.g., heating process streams, generating steam, drying materials, etc. The burning of fuels, however, can result in the formation of nitrogen oxides ($NO_x$) which when released to the atmosphere constitute pollutants. As a result, environmental emission standards have been imposed by various governmental authorities and agencies which require the inhibition of the formation of nitrogen oxides during fuel-air combustion.

Various methods and burner apparatus for combusting fuel-air mixtures while suppressing the formation of nitrogen oxides have been developed. For example, U.S. Pat. No. 4,004,875 issued Jan. 25, 1977, is directed to a low $NO_x$ burner wherein the fuel is first burned in a zone in which there is less than a stoichiometric concentration of air thereby producing a reducing environment that suppresses $NO_x$ formation with the deficiency in air being made up in a subsequent burning zone.

Fuel staging has also been employed for suppressing $NO_x$ formation. That is, a portion of the fuel is burned in a first zone with air being supplied at a rate in excess of the stoichiometric rate required with the remaining fuel being burned in a second zone. The presence of excess air in the first zone lowers the temperature of the combustion reaction and suppresses $NO_x$ formation. The fuel in the second zone reacts with the excess oxygen resulting from the combustion in the first zone and is diluted with surrounding combustion gases which lowers the combustion reaction temperature and suppresses the formation of $NO_x$ in the second zone. A multi-stage combustion method of this type is described in U.S. Pat. No. 4,395,223 issued July 26, 1983.

While methods and burner apparatus utilizing staged combustion have been successful in reducing $NO_x$ emissions heretofore, the methods have required elaborate burner apparatus to carry out, i.e., apparatus including a plurality of fuel nozzles and/or complex air or recycle gas distribution systems making the apparatus expensive to install and operate.

By the present invention improved methods and burner apparatus for combusting fuel-air mixtures while inhibiting the formation of nitrogen oxides are provided which are simple and inexpensive as compared to prior art methods and apparatus.

SUMMARY OF THE INVENTION

Methods of combusting fuel-air mixtures whereby the formation of nitrogen oxides is inhibited are provided. In accordance with the methods, fuel is discharged from a nozzle disposed within a burner housing, air is introduced into the housing which is mixed with the fuel and the resulting fuel-air mixture is ignited and combusted. A first portion of the fuel is discharged from the nozzle through one or more orifices therein whereby the fuel mixes with air and provides an ignition zone adjacent the nozzle. A second portion of the fuel is discharged from the nozzle by way of one or more additional orifices whereby the second portion of fuel is distributed in a turbulent pattern which exposes the fuel to a quantity of air in excess of that required for the stoichiometric burning thereof and causes the fuel to burn in a primary combustion zone. The remaining portion of the fuel is discharged from the nozzle by way of one or more additional orifices which are surrounded by one or more fuel discharge recesses whereby high velocity jets of fuel shielded by slow moving fuel are produced and the fuel is distributed within and downstream of the primary combustion zone. This portion of the fuel is mixed with excess air from the primary combustion zone and combustion products and is burned in a secondary combustion zone substantially shielded from direct contact with incoming air by the primary combustion zone. Burner apparatus for carrying out the methods are also provided.

It is, therefore, a general object of the present invention to provide low $NO_x$ formation fuel burning methods and apparatus.

A further object of the present invention is the provision of improved methods of combusting fuel-air mixtures whereby the formation of nitrogen oxides is inhibited which can be carried out in relatively simple and inexpensive burner apparatus.

Another object of the present invention is the provision of improved burner apparatus for combusting fuel-air mixtures while inhibiting the formation of nitrogen oxides.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
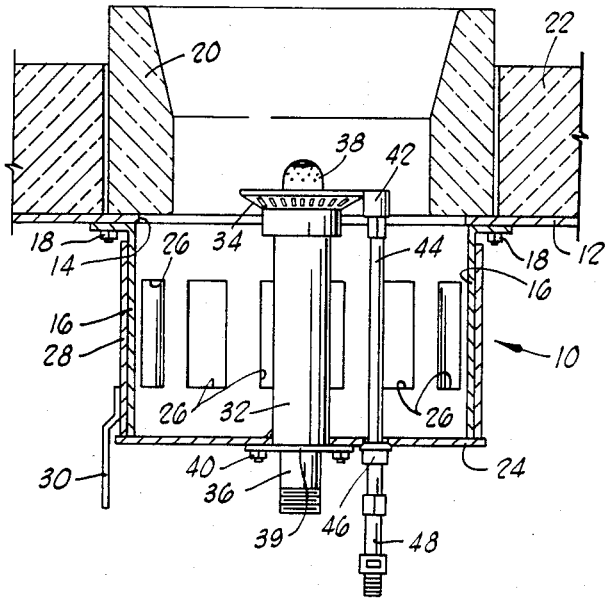
FIG. 1 is a side cross-sectional view of the low $NO_x$ formation fuel burning apparatus of the present invention.
Figure 2:
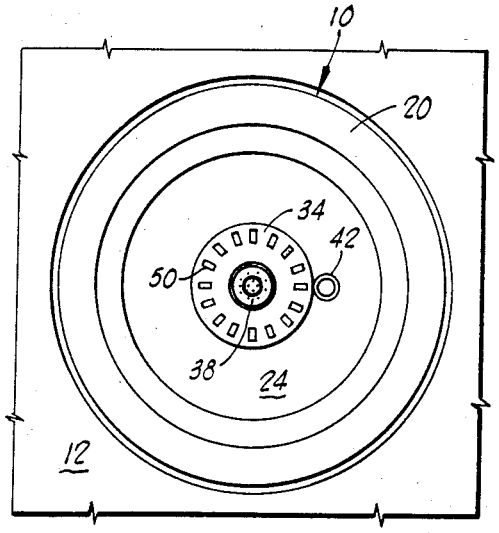
FIG. 2 is a top plan view of the apparatus of FIG. 1.

Referring not to the drawings and particularly to FIGS. 1 and 2, a burner apparatus of the present invention is illustrated and generally designated by the numeral 10. The burner apparatus 10 is shown connected in an opening 14 provided in the floor or wall 12 of a furnace chamber such as the furnace chamber of a process heater containing heat exchange tubes, or a steam generator. The burner apparatus 10 is designed for use in applications where gaseous fuels such as hydrocarbon gases are combusted. However, it will be appreciated by those skilled in the art that burner apparatus including the present invention can take a variety of forms.

The burner 10 includes a housing which is comprised of an external cylindrical housing member 16 attached over the opening 14 in the wall 12, such as by a plurality of bolt members 18, and a heat resistant member 20 formed of refractory material mounted within the furnace chamber defined by the wall 12. The interior of the wall 12 includes an insulating layer of refractory material 22 in which an opening is formed for receiving the member 20 of the burner 10. The member 20 can be attached to the wall 12 and/or refractory material 22 of the furnace chamber as illustrated or it can be attached to the cylindrical housing member 16 in any convenient manner.

The housing member 16 functions as an air register, and for this purpose, includes a plurality of air inlet openings 26 disposed in and around the sides thereof. A wall 24 closes the end of the housing member 16 and a cylindrical damper 28 is rotatably positioned over the housing member. The damper 28 includes air openings (not shown) therein complementary to the air openings 26 in the housing member 16. A handle 30 is attached to the damper 28 so that the damper can be rotated between a position whereby the openings 26 are closed by solid portions of the damper 28 and a position whereby the openings in the damper 28 are in registration with the openings 26 to provide full air flow as shown in FIG. 1.

A guide tube 32 is disposed coaxially within the cylindrical housing member 16, the outer end of which is rigidly attached through an opening in the wall 24, such as by welding. The inner end of the guide tube 32 has a shielding cone 34 attached thereto. A fuel supply conduit 36 extends through the guide tube 32 which has a fuel discharge nozzle 38 connected at the inner end thereof. The exterior end of the conduit 36 is threaded for connection to a source of fuel and the conduit 36 is sealingly attached to a plate 39 which is in turn removably connected by means of bolt members 40 to the wall 24.

A pilot 42 is provided for igniting fuel discharged from the nozzle 38 and is connected to a supply conduit 44 which in turn extends through an opening in the wall 24 and a removable closure member 46 connected thereto. The outer end of the supply conduit 44 is connected to a pilot fuel-air mixer 48 which is in turn adapted for connection to a source of pilot fuel.

Figure 3:
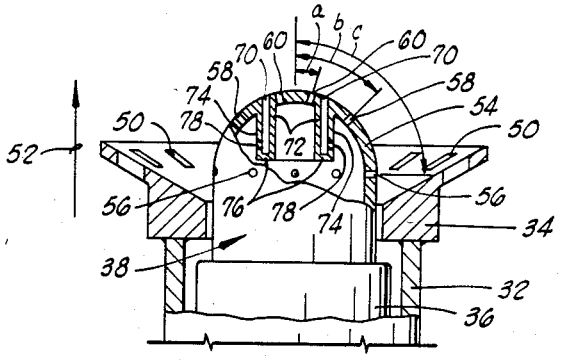
FIG. 3 is an enlarged partly sectional view of a portion of the apparatus of FIG. 1 including the fuel discharge nozzle thereof.
Figure 4:
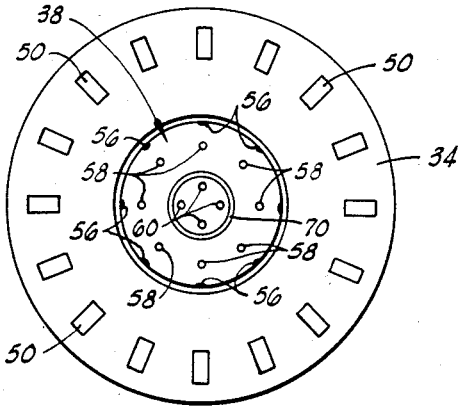
FIG. 4 is a top plan view of the apparatus of FIG. 3.

Referring now to FIGS. 3 and 4, the fuel discharge nozzle 38, shielding cone 34 and related structure are illustrated in detail. The shielding cone 34 is dish-shaped and includes a plurality of openings 50 formed therein for allowing the passage of a limited amount of air therethrough. The shielding cone 34 functions to create a protected area adjacent the nozzle 38 when incoming air is flowing in the direction indicated by the arrow 52 of FIG. 3. As will be understood, the creation of a protected area adjacent the nozzle 38 can be brought about by various types and shapes of apparatus other than the shielding cone 34.

The nozzle 38 extends through a central opening in the shielding cone 34 and includes an end wall 54 which contains a plurality of fuel discharge orifices and an annular fuel discharge recess. More particularly, the wall portion 54 of the nozzle 38 includes a first set of one or more orifices 56 disposed therein. When more than one orifice 56 are utilized, they preferably are all the same size and are positioned in equally spaced relationship around the nozzle 38 in a plane preferably perpendicular to the axis of the nozzle 38, i.e., the angle designated by the letter "c" on FIG. 3 is preferably 90°. The axis of the nozzle 38 is parallel to the axis of the housing member 16 whereby the axes of the orifices 56 lie in a plane substantially perpendicular to the direction of air flow through the housing member 16. The first set of orifices 56 discharge a first portion of the fuel supplied to the nozzle 38 which mixes with a portion of the incoming air and provides an ignition zone adjacent the nozzle 38 as will be described further hereinbelow. The shielding cone 34 provides a protected area adjacent the nozzle 38 which prevents the ignition zone from being moved away from the nozzle 38, i.e., the shielding cone retains an ignition flame adjacent the nozzle 38.

A second set of one or more orifices 58 is disposed in the wall portion 54 of the nozzle 38. When more than one orifice 58 are utilized, they preferably are all of the same size and are positioned in equally spaced relationship around the wall 54 interiorly of and above the ignitiion orifices 56. The axes of the orifices 58 are also preferably inclined in the direction of flow of air at an angle in the range of from about 15° to about 70° therewith, i.e., the axes of the orifices 58 are all preferably positioned at the same angle with respect to the axis of the nozzle 38 (the angle designated by the letter "b" in FIG. 3) which is in the range given above. The second set of orifices 58 discharge a second portion of the fuel supplied to the nozzle 38 which is distributed in a turbulent outwardly flaring pattern. The second portion of fuel mixes with the remaining incoming air which is in excess of that required for the stoichiometric burning thereof and burns in a primary combustion zone.

A third set of one or more orifices 60 is disposed in the wall portion 54 of the nozzle 38 interiorly of and above the primary combustion orifices 58. Like the orifices 56 and 58, when more than one orifice 60 are utilized, they are preferably all of the same size and are positioned in spaced relationship on a circular pattern in the nozzle 38. The axes of the orifices 60 can be parallel to the axis of the nozzle 38 and to the direction 52 of air flow, or, as shown in FIG. 3, the axes of the orifices 60 can be inclined at an angle in the range of from about 1° to about 30° therewith (the angle "a" shown on FIG. 3). It is to be noted that angle "a" can be about equal to or less than the angle "b", but should not be greater than the angle "b".

Figure 6:
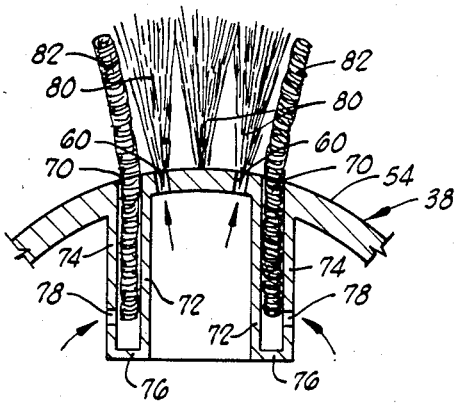
FIG. 6 is an enlarged partial view of a portion of the fuel discharge nozzle of FIG. 3 illustrating the operation thereof.

As shown in FIGS. 3, 4 and 6, an annular recess 70 is formed in the nozzle 38 surrounding the orifices 60. As illustrated in FIG. 3, the annular recess 70 is formed by adjacent cylindrical walls 72 and 74 connected at their top ends to the wall 54 and at their bottom ends to an annular wall 76. One or more ports 78 are preferably disposed in the cylindrical wall 74 whereby the recess 70 is communicated with the interior of the nozzle 38. The annular recess 70 is preferably of relatively large cross-sectional area as compared to the ports 78.

The orifices 60 discharge a major part of the remaining portion of fuel supplied to the nozzle 38 in the form of high velocity jets while the other minor part is discharged from the annular recess 70 in the form of a relatively slow moving cylinder of fuel. Substantially all of such remaining portion of fuel, however, is burned in a secondary combustion zone within and downstream of the primary combustion zone created by the discharge of the second portion of fuel from the orifices 58.

Figure 5:
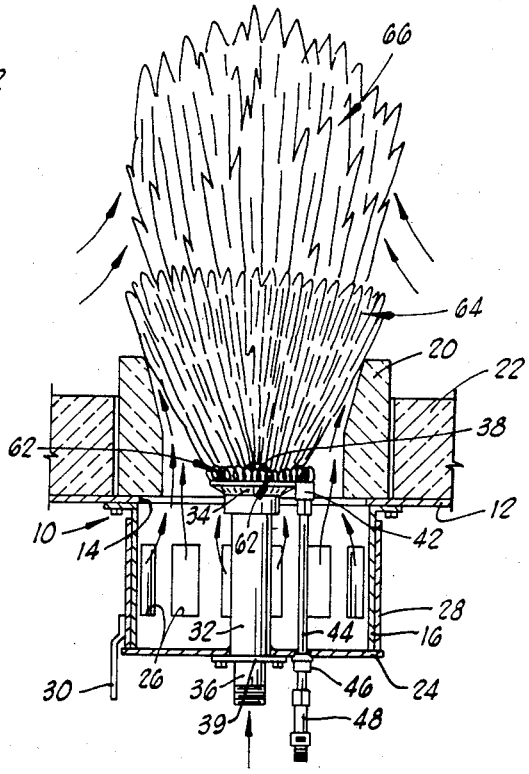
FIG. 5 is a side cross-sectional view of the burner apparatus of FIG. 1 illustrating the operation of the apparatus.

Referring now to FIGS. 5 and 6, in operation of the burner apparatus 10, fuel under pressure, i.e., a pressure generally in the range of from about about 3 to about 30 psig., is supplied to the conduit 36. Pilot fuel at a pressure in the range of from about 3 to about 15 psig. is supplied to the air mixer 48. The pilot fuel is mixed with air while flowing through the mixer 48 and the resulting fuel-air mixture is discharged from the pilot 42, ignited and burned. The flame from the pilot functions to ignite the fuel discharged from the nozzle 38. However, it is to be noted that other ignition means can be utilized and the use of a pilot burner is optional.

The pressurized fuel supplied to the conduit 36 flows to the nozzle 38 connected thereto and is discharged into the furnace chamber through the orifices 56, 58 and 60 and the recess 70 therein. The first set of orifices, i.e., the ignition orifices 56, are of a size and/or number whereby the first portion of fuel discharged therethrough is at a rate in the range of from about 1% to about 25% of the total rate of fuel discharged from the nozzle 38. Such portion of the fuel mixes with air in the protected area adjacent the nozzle 38, is ignited by the flame from the pilot 42 or other means and burns in an ignition area 62 adjacent the shielding cone 34 and nozzle 38.

The second set of orifices, i.e., the primary combustion orifices 58, are of a size and/or number such that a second portion of fuel is discharged therethrough at a rate in the range of from about 1% to about 60% of the total rate of fuel discharged from the nozzle 38. The second portion of fuel is distributed in an outwardly flaring pattern from the nozzle 38 in a turbulent manner which causes the fuel to mix with air flowing into the housing of the burner 10 by way of the openings 26 in the housing member 16 thereof. The rate of air flowing into the burner 10 is adjusted by adjusting the position of the damper 28 on the housing member 16 whereby the total rate of air is substantially equal to or greater than that required for the stoichiometric burning of the total rate of fuel discharged from the nozzle 38. The second portion of fuel and air mixture produced is combusted in a primary combustion zone 64 which flares outwardly from the nozzle 38. Because the second portion of fuel is mixed with air in excess of that required for the stoichiometric burning of the fuel, the temperature in the primary combustion zone 64 is lowered and the formation of $NO_x$ in the primary combustion zone is inhibited.

The remaining porton of the fuel supplied to the nozzle 38 is discharged therefrom by way of the annular recess 70 and the third set of orifices therein, i.e., the secondary combustion orifices 60. As illustrated in FIG. 6, the jets 80 of fuel discharged through the orifices 60 are initially shielded by a slower moving cylinder of fuel 82 discharged from the circular recess 70. The fuel enters the annular recess 70 by way of the ports 78 in the wall 74. The slower moving shield of fuel 82 prevents the immediate mixture of the faster moving fuel jets 80 with air and the combustion thereof, i.e., the presence of the slower moving shield of fuel 82 from the recess 70 around the fast moving jets of fuel 80 discharged from the orifices 60 delays the burning of the jets of fuel and causes the combustion reaction to take place at a lower temperature. In addition, the fuel from the recess 70 and orifices 60 is distributed within and downstream of the primary combustion zone 64 into a secondary combustion zone 66 which is substantially shielded from direct contact with incoming air by the primary combustion zone 64. The fuel in the secondary combustion zone is mixed with air from the primary combustion zone which is diluted with combustion products from the primary combustion zone.

Thus, because the remaining portion of fuel discharged through the secondary combustion orifices 60 and recess 70 is discharged in a manner whereby high velocity jets of fuel shielded by slower moving fuel are produced, because the fuel is burned in a secondary combustion zone 66 within and downstream of the primary combustion zone 64, and because the air mixed with such remaining portion of fuel is diluted with combustion products, the combustion takes place at a relatively low temperature whereby the formation of $NO_x$ is inhibited.

Figure 7:
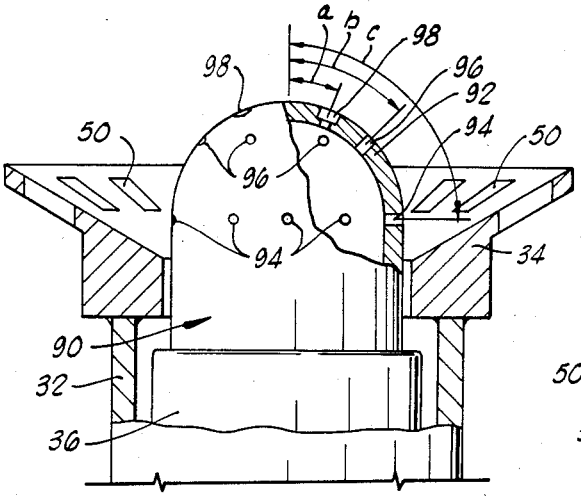
FIG. 7 is an enlarged partly sectional view similar to FIG. 3 but illustrating an alternate fuel discharge nozzle.
Figure 8:
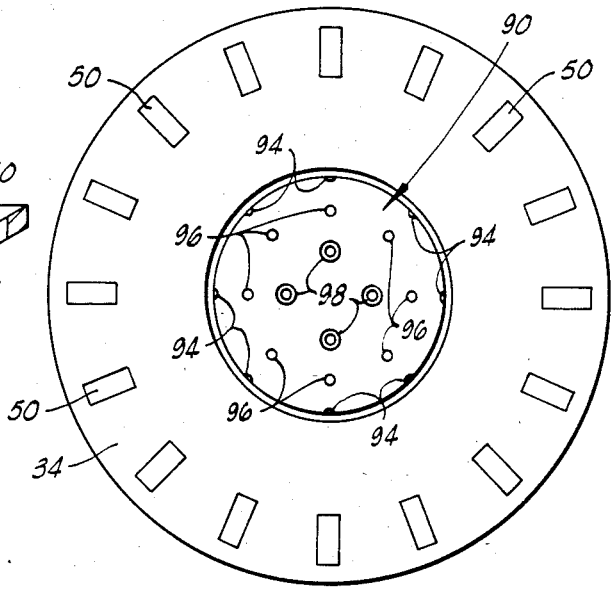
FIG. 8 is a top plan view of the apparatus of FIG. 7.
Figure 9:
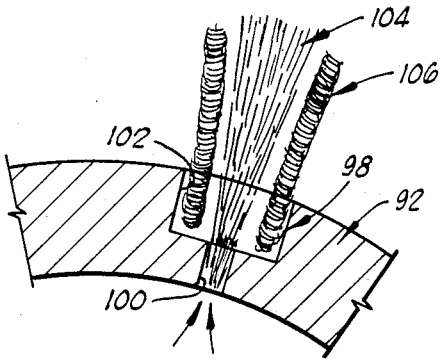
FIG. 9 is an enlarged partial view of a portion of the fuel discharge nozzle of FIG. 7 illustrating the operation thereof.

Referring now to FIGS. 7, 8 and 9, an alternate form of fuel discharge nozzle, designated by the numeral 90, is shown connected to the supply conduit 36 in lieu of the nozzle 38. The nozzle 90 functions in substantially the same manner as the nozzle 38 and includes an end wall 92. The wall 92 contains a set of one or more ignition orifices 94 and a set of one or more primary combustion orifices 96 which are positioned and function in an identical manner to the ignition orifices 56 and primary combustion orifices 58 described above in connection with the nozzle 38. In lieu of the annular recess 70 and ports 78 and the secondary combustion orifices 60 included in the nozzle 38, the nozzle 90 includes a set of one or more recessed secondary combustion orifices 98 which function in a substantially equivalent manner to the combination of recess 70, ports 78 and orifices 60 of the nozzle 38. The recessed orifices 98 are positioned in the nozzle 90 in the same manner as described above for the orifices 60 of the nozzle 38, but differ from the orifices 60 by the inclusion of an enlarged cylindrical recess therein. More specifically, as best shown in FIG. 9, each of the orifices 98 includes a small diameter cylindrical portion 100 adjacent the inlet side of the wall 92 and an enlarged diameter cylindrical portion or recess 102 adjacent the outlet side of the wall 92.

In operation, each of the recessed orifices 98 produces a central high velocity jet of fuel 104 which is surrounded and shielded by a slower moving cylinder of fuel 106. The high velocity jet of fuel 104 is formed by the small diameter cylindrical portion 100 of the recessed orifice 98 and as the jet flows through the enlarged recess 102 thereof, a portion of the fuel in the jet moves into the annular space between it and the walls of the recess 102, slows down and forms the slower moving shield of fuel 106. As described above with respect to the nozzle 38, the slower moving shields of fuel delay the burning of the jets of fuel discharged through the recessed orifices 98 which contributes to the reduction of the combustion temperature and the formation of nitrogen oxides.

It will now be apparent that various other arrangements of recessed orifices within the scope of this invention can be used. For example, a plurality of recessed orifices 98 surrounding the orifices 60 can be substituted for the annular recess 70 and ports 78 in the nozzle 38.

The method of the present invention whereby fuel can be discharged from a single nozzle or two or more nozzles and burned with low $NO_x$ formation is comprised of the steps of discharging a first portion of the fuel from each nozzle through one or more orifices, or a set of orifices therein, whereby the fuel mixes with air and provides an ignition zone adjacent the nozzle; discharging a second portion of the fuel through one or more additional orifices, or a second set of orifices therein, whereby the second portion of fuel is distributed in a turbulent pattern which causes the fuel to mix with a rate of air in excess of that required for the stoichiometric burning thereof and to burn in a primary combustion zone; and discharging the remaining portion of the fuel from the nozzle through one or more additional orifices, or a third set of orifices therein, which produce high velocity jets of fuel shielded by slower moving fuel. The discharged remaining portion of the fuel is distributed within and downstream of the primary combustion zone wherein it is mixed with air from the primary combustion zone which is diluted with combustion products from the primary combustion zone and with recirculated combustion products. The resulting mixture of fuel and combustion product diluted air is burned in the secondary combustion zone.

As mentioned above, because the combustion in the primary combustion zone takes place in excess air, the flame temperature in such zone is lowered whereby the formation of $NO_x$ is inhibited. Combustion in the secondary combustion zone is delayed because the secondary combustion zone is shielded by the primary zone from direct contact with in-coming air and because the high velocity jets of fuel feeding the secondary combustion zone are further shielded from the air by low-velocity fuel. This delay in the mixing of the fuel and air allows for dilution of the air with combustion products from the primary combustion zone and from within the combustion chamber, resulting in a lower combustion temperature which inhibits the formation of $NO_x$ in the secondary combustion zone.

While the present invention has been described as it relates to a natural draft burner apparatus, it is to be understood that the invention is applicable to a wide variety of burner designs, including those utilizing forced draft. In addition, more than one fuel discharge nozzle of the present invention can be utilized in a single burner apparatus, for example, the burner apparatus disclosed in U.S. Pat. No. 3,033,273 issued on May 8, 1962. Further, the fuel discharge nozzle and shielding cone utilized in accordance with this invention can both take various other forms and shapes so long as the functional limitations described above are met thereby.

In order to facilitate a clear undestanding of the method and apparatus of the present invention, the following example is given.

EXAMPLE

A burner apparatus 10 designed for a heat release of 6,000,000 BTU/hr by burning natural gas having a caloric value of 930 BTU/SCF is fired into a furnace chamber. The nozzle 38 includes a first set of 6 orifices 56 of 0.0625 inch diameter, a second set of 4 orifices 58 of 0.1405 inch diameter and a third set of 4 orifices 60 of 0.1875 inch diameter. The annular recess 70 has an inside diameter of 0.625 inch and an outside diameter of 0.95 inch, is 0.90 inch deep and includes 4 ports 78 of 0.0625 inch size. The axes of the orifices 56 are at an angle of 90° with the axis of the nozzle 38, the axes of the orifices 58 are at an angle of 40° with the axes of the nozzle 38 and the axes of the orifices 60 are at an angle of 10° therewith.

The fuel is supplied to the nozzle 38 at a pressure of about 15 psig. and at a rate of about 6452 SCF/hr. The first portion of fuel discharged through the ignition nozzles 56 is at a rate of about 596 SCF/hr., the second portion of fuel discharged through the primary combustion orifices 58 is at a rate of about 1986 SCF/hr., and the remaining portion of fuel discharged through the secondary combustion orifices 60 and recess 70 is at a rate of about 3870 SCF/hr.

The discharged fuel is combined with air in the burner apparatus 10 and burned whereby a heat release in the furnace chamber of about 6,000,000 BTU/hr. is realized. The stack emissions from the furnace chamber contain a $NO_x$ concentration of less than about 30 ppm. A conventional burner including a conventional nozzle fired in the furnace chamber in the same manner and under the same conditions creates stack emissions containing a $NO_x$ concentration of more than about 70 ppm.

Thus, the present invention is well adapted to carry out the objects and attain the advantages mentioned as well as those inherent therein. While presently preferred embodiments of the invention have been described herein for purposes of this disclosure, numerous changes in the construction of parts and in the arrangement of parts and steps will suggest themselves to those skilled in the art, which changes are encompassed within the spirit of this invention as defined by the appended claims.

What is claimed is:

1. In a burner apparatus for combusting a fuel-air mixture wherein fuel is discharged from at least one nozzle disposed within a chamber, air is caused to flow into the chamber whereby it mixes with the fuel and the resulting fuel-air mixture is ignited and combusted, the improvement whereby the formation of nitrogen oxides is inhibited comprising:

said nozzle having one or more ignition orifices disposed therein positioned to discharge a first portion of said fuel therethrough whereby said fuel mixes with air and provides an ignition zone adjacent said nozzle;

one or more primary combustion orifices disposed in said nozzle positioned to discharge a second portion of said fuel therethrough whereby said fuel is distributed in a turbulent pattern which causes said fuel to mix with a rate of air in excess of that required for the stoichiometric burning thereof and to burn in a primary combustion zone; and one or more secondary combustion orifices surrounded by a fuel discharge recess, the secondary orifices and recess being disposed in said nozzle interiorly of said primary combustion orifices and positioned to discharge the remaining portion of said fuel therethrough in the form of high velocity jets of fuel shielded by slower moving fuel whereby said fuel is distributed within and downstream of said primary combustion zone, is mixed with air from said primary combustion zone diluted with combustion products and is burned in a secondary combustion zone substantially isolated from direct contact with incoming air by said primary combustion zone.

2. The burner apparatus of claim 1 which is further characterized to include means attached thereto for creating a protected area adjacent said nozzle and said one or more ignition orifices therein.

3. The burner apparatus of claim 1 wherein said one or more ignition orifices are of a size whereby said first portion of said fuel is a rate in the range of from about 1% to about 25% of the total rate of fuel discharged from said nozzle.

4. The burner apparatus of claim 3 wherein said one or more primary combustion orifices are of a size whereby said second portion of fuel is a rate in the range of from about 1% to about 60% of the total rate of fuel discharged from said nozzle.

5. In a burner apparatus for combusting a fuel-air mixture wherein fuel is discharged from a nozzle disposed within a housing, air is caused to flow into the housing whereby it mixes with the fuel and the resulting fuel-air mixture is ignited and combusted, the improvement whereby the formation of nitrogen oxides is inhibited comprising:

said nozzle having one or more ignition orifices disposed therein positioned transversely to the direction of flow of said air and being of a size and number such that a first portion of said fuel is discharged therethrough which mixes with air and provides an ignition zone adjacent said nozzle;

one or more primary combustion orifices disposed in said nozzle positioned transversely to the direction of flow of said air and being of a size and number such that a second portion of said fuel is discharged therethrough and distributed in a turbulent pattern which causes said fuel to mix with an amount of air in excess of that required for the stoichiometric burning thereof and to burn in a primary combustion zone; and one or more secondary combustion orifices surrounded by one or more fuel discharge recesses disposed in said nozzle interiorly of said primary combustion orifices of a size and number such that the remaining portion of said fuel is discharged therethrough in the form of high velocity jets of fuel shielded by slower moving fuel, is distributed within and downstream of said primary combustion zone, is mixed with air from said primary combustion zone which is diluted with combustion products and is burned in a secondary combustion zone substantially isolated from direct contact by incoming air by said primary combustion zone.

6. The burner apparatus of claim 5 which is further characterized to include an air shielding means for creating a protected area downstream thereof disposed adjacent said nozzle and said one or more ignition orifices therein.

7. The burner apparatus of claim 5 wherein said first portion of said fuel is a rate in the range of from about 1% to about 25% of the total rate of fuel discharged from said nozzle.

8. The burner apparatus of claim 5 wherein said second portion of fuel is a rate in the range of from about 1% to about 60% of the total rate of fuel discharged from said nozzle.

9. The burner apparatus of claim 5 wherein the axes of said one or more ignition orifices are substantially perpendicular to the direction of flow of said air into said housing, the axes of said one or more primary combustion orifices are inclined in the direction of flow of said air at an angle in the range of from about 15° to about 70° therewith and the axes of said one or more secondary combustion orifices are parallel to or inclined in the direction of flow of said air into said housing at an angle in the range of from about 1° to about 30° therewith.

10. In a burner apparatus for combusting a fuel-air mixture wherein fuel is discharged from a nozzle disposed centrally within a cylindrical housing, air is caused to flow into the housing whereby it mixes with the fuel and the resulting fuel-air mixture is ignited and combusted, the improvement whereby the formation of nitrogen oxides is inhibited comprising:

said nozzle having a first set of orifices disposed therein positioned to discharge fuel therearound in a plane substantially perpendicular to the axis of said nozzle and being of a size and number such that a first portion of said fuel is discharged therethrough which mixes with air and provides an ignition zone adjacent said nozzle;

air shielding means for creating a protected area adjacent said first set of orifices attached within said housing;

a second set of orifices disposed in said nozzle positioned to discharge fuel therearound in an outwardly flaring pattern and being of a size and number such that a second portion of said fuel is discharged therethrough with turbulence which causes said fuel to mix with an amount of air in excess of that required for the stoichiometric burning thereof and to burn in an outwardly flaring primary combustion zone; and a third set of orifices surrounded by one or more fuel discharge recesses disposed in said nozzle positioned interiorly of said second set of orifices and being of a size and number such that the remaining portion of said fuel is discharged therethrough in the form of high velocity jets of fuel shielded by slower moving fuel, is distributed within and downstream of said outwardly flaring primary combustion zone, is mixed with air from said primary combustion zone which is diluted with combustion products and is burned in a secondary combustion zone substantially isolated from direct contact with incoming air by said primary combustion zone.

11. The burner apparatus of claim 10 wherein said first portion of fuel is a rate in the range of from about 1% to about 25% of the total rate of fuel discharged from said nozzle and said second portion of fuel is a rate in the range of from about 1% to about 60% of the total rate of fuel discharged from said nozzle.

12. The burner apparatus of claim 11 wherein the portion of said nozzle containing said orifices is hemispherical in shape and said first set of orifices lies in a plane substantially perpendicular to the axis of said nozzle, the orifices of said second set are inclined at an angle in the range of from about 15° to about 70° with the axis of said nozzle and the orifices of said third set are parallel to or are inclined at an angle of from about 1° to about 30° with the axis of said nozzle.

* * * * *